US010758055B2

(12) United States Patent
Whalen et al.

(10) Patent No.: US 10,758,055 B2
(45) Date of Patent: Sep. 1, 2020

(54) FOOT SWING

(71) Applicant: Mindful Mission, LLC, Mooresville, NC (US)

(72) Inventors: Jodi B. Whalen, Mooresville, NC (US); Daniel M. Whalen, Mooresville, NC (US)

(73) Assignee: Mindful Mission, LLC, Mooresville, NC (US)

( * ) Notice: Subject to any disclaimer, the term of this patent is extended or adjusted under 35 U.S.C. 154(b) by 0 days.

(21) Appl. No.: 16/103,118

(22) Filed: Aug. 14, 2018

(65) Prior Publication Data

US 2019/0059599 A1 Feb. 28, 2019

Related U.S. Application Data

(60) Provisional application No. 62/548,598, filed on Aug. 22, 2017.

(51) Int. Cl.
*A47C 16/02* (2006.01)
*A47C 7/52* (2006.01)

(52) U.S. Cl.
CPC ..... *A47C 16/025* (2013.01); *A47C 7/52* (2013.01)

(58) Field of Classification Search
CPC ..... A47C 16/02; A47C 16/025; A47C 7/52; B64D 11/0643
USPC ..... 297/423.19, 423.26, 423.27, 423.35, 297/423.38, 423.39, 423.41, 42, 3.43, 297/423.44, 423.45, 423.46, 423.43
See application file for complete search history.

(56) References Cited

U.S. PATENT DOCUMENTS

D170,100 S * 7/1953 Torsak ..... D6/353
3,119,356 A * 1/1964 Sauer ..... A47C 16/025 108/8
D252,426 S * 7/1979 Brelsford ..... D6/349
4,296,694 A * 10/1981 Kobayashi ..... A47C 16/025 108/116
4,536,032 A * 8/1985 Highberger ..... A47C 16/025 297/118
4,544,203 A * 10/1985 Younger ..... A47G 9/1009 108/118
4,828,321 A * 5/1989 Harper ..... A47G 9/1009 297/188.2
5,509,360 A * 4/1996 Chiu ..... A47B 3/02 108/119
5,522,642 A * 6/1996 Herzog ..... A47C 3/38 248/188.2
D466,706 S * 12/2002 Malizia ..... D6/349
6,695,754 B1 * 2/2004 Gazzolo ..... A63B 23/12 482/141
D493,293 S * 7/2004 Vira ..... D6/349
(Continued)

*Primary Examiner* — Kyle J. Walraed-Sullivan
(74) *Attorney, Agent, or Firm* — Trego, Hines & Ladenheim, PLLC; Brandon Trego; Jonathan Hines

(57) ABSTRACT

A foot swing is disclosed. The foot swing including a first support having a first leg pivotally connected to a second leg; a second support spaced from the first support, the second support having a first leg pivotally connected to a second leg; and a foot support extending between the first and second supports, the foot support including a first distal end pivotally connected to the first support and a second distal end pivotally connected to the second support to permit the foot support to move relative to the first and second supports.

15 Claims, 11 Drawing Sheets

(56) References Cited

U.S. PATENT DOCUMENTS

| | | | | |
|---|---|---|---|---|
| 8,267,477 | B1 * | 9/2012 | Appiah Finn | A47C 16/025<br>108/115 |
| 2007/0001502 | A1 * | 1/2007 | Welsh | A47C 7/52<br>297/423.4 |
| 2010/0133890 | A1 * | 6/2010 | Port | A47C 16/025<br>297/423.46 |
| 2010/0163055 | A1 * | 7/2010 | Wilkinson | A47C 16/025<br>128/845 |
| 2018/0168412 | A1 * | 6/2018 | Pham | A47K 17/028 |

* cited by examiner

FOOT SWING

BACKGROUND OF THE INVENTION

This invention relates generally to a foot swing, and more particularly to a portable foot swing for use with or under a structure.

Whether people are learning or working, staying focused in a world of distraction can be very difficult. For example, these days, children are so mentally stimulated by computers, tablets, televisions, smart phones, etc. that it can be very difficult for them to focus on a single operation as their minds are scattered by all of the things they are exposed too.

One area where focus is particularly important is in the education of our children. Children need to be able to focus on the lesson that is being taught by their instructors. Often the children are day-dreaming or are so distracted that they simply cannot comprehend what is being taught or simply do not hear what the instructor is saying. Another area of concern is the need to move or fidget while sitting at their workstations or desks. This need to move is often the result of excess energy, learning disabilities, or from disorders such as Attention Deficit Disorder (ADD) or Attention Deficit Hyperactive Disorder (ADHD), Autism or Asperger's, and Sensory Processing Disorder (SPD). It has been found that movement can often times provide a calming effect and/or stimulation to the brain for children at their workstation or desk and allow them to better focus on the lessons being taught. Instead of allowing children to get up and move around the classroom, which would distract other children, the children need to be able to move and refocus at their workstation or desk without additional distractions to the class.

Accordingly, there is a need for a foot swing that provides motion to refocus a child's mind to the task at hand and provide sensory input.

BRIEF SUMMARY OF THE INVENTION

This need is addressed by the present invention, which provides a portable foot swing configured for placement under a student's workstation or desk to allow the student to swing his/her feet or push on an elastic member to provide a bouncing sensation.

According to an aspect of the invention, a foot swing includes a first support having a first leg pivotally connected to a second leg; a second support spaced from the first support, the second support having a first leg pivotally connected to a second leg; and a foot support extending between the first and second supports, the foot support including a first distal end pivotally connected to the first support and a second distal end pivotally connected to the second support to permit the foot support to move relative to the first and second supports.

According to another aspect of the invention, a foot swing includes a first support spaced-apart from a second support, each of the first and second supports having a first leg pivotally connected to a second leg; a foot support extending between the first and second supports, the foot support including a first distal end pivotally connected to the first support and a second distal end pivotally connected to the second support to permit the foot support to move relative to the first and second supports; and an elastic member extending between the first and second supports.

According to another aspect of the invention, a method of using a foot swing includes the steps of assembling the foot swing, including the steps of moving a first support to an open position; moving a second support to an open position; inserting a first distal end of a foot support into an aperture of the first support and inserting a second distal end of the foot support into an aperture of the second support; and interconnecting the first and second supports using first and second connectors extending between the first and second supports. The method further including the step of placing a user's foot on the foot support and moving the foot support back and forth.

BRIEF DESCRIPTION OF THE DRAWINGS

The invention may be best understood by reference to the following description taken in conjunction with the accompanying drawing figures, in which.

DETAILED DESCRIPTION OF THE INVENTION

Figure 1:
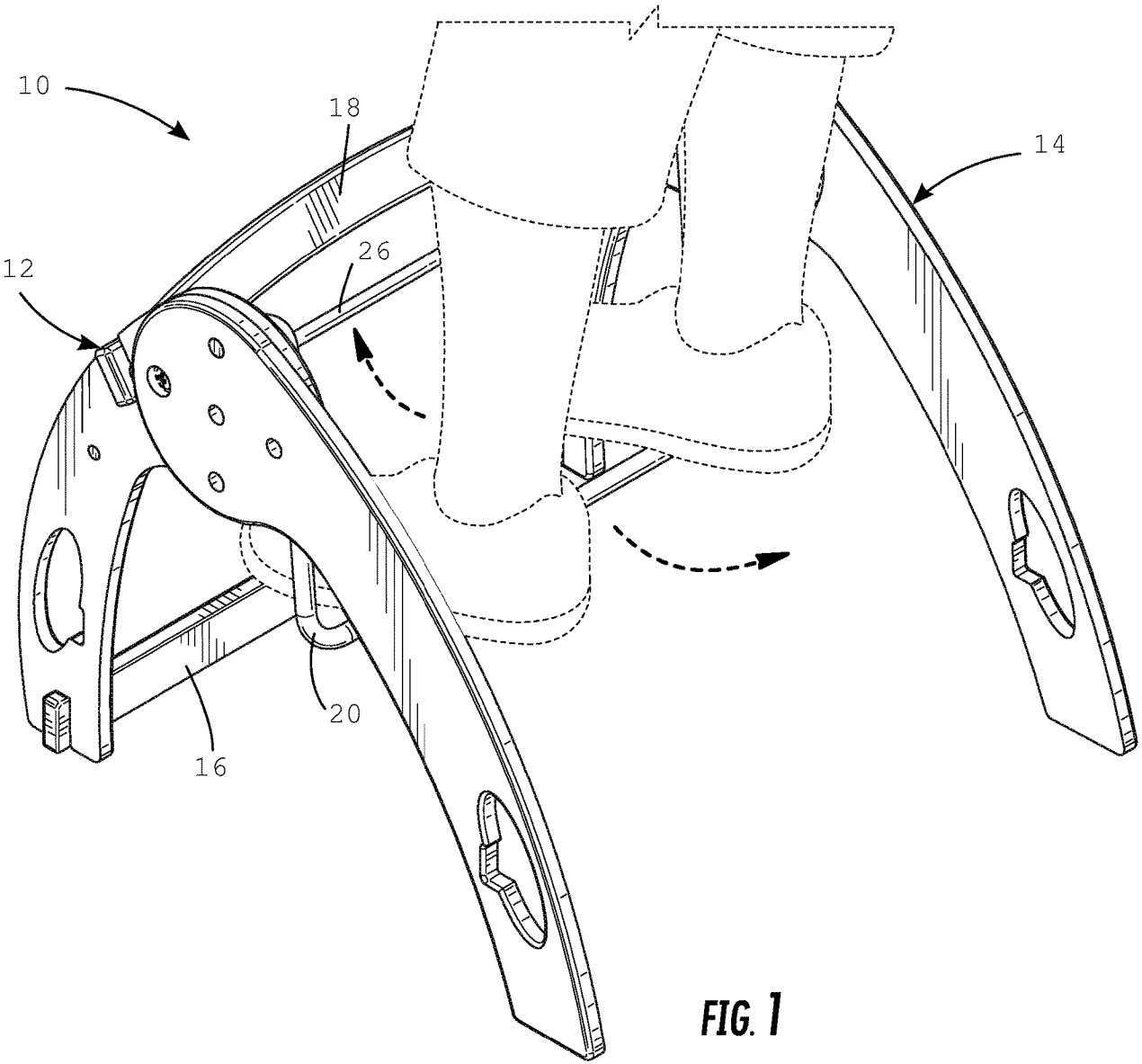
FIG. 1 shows a portable foot swing.

Referring to the drawings wherein identical reference numerals denote the same elements throughout the various views, FIGS. 1-8 illustrate a portable foot swing 10. The foot swing 10 includes first and second spaced-apart supports 12 and 14 interconnected by a lower connecter bar 16 and an upper connector bar 18, a foot support 20 having distal ends 22 and 24 pivotally connected between the first and second supports 12 and 14, and an elastic member 26 extending between the first and second supports 12 and 14.

The first support 12 includes a first leg 30 pivotally connected to a second leg 32 by a fastener and/or connector 34. The first leg 30 has a distal end 36 adapted to rest on a support surface, such as a floor, and a proximal end 38 configured for pivotal engagement with the second leg 32. The first leg 30 has an outer face 40 and an inner face 42, an aperture 43 positioned near the distal end 36 and extending through the first leg 30 from the outer face 40 to the inner face 42, and a plurality of apertures 44, 46, 48, 50, and 52 positioned on the proximal end 38 extending through the first leg 30 from the outer face 40 to the inner face 42.

The second leg 32 also includes a distal end 54 adapted to rest on a support surface and a proximal end 56 configured for pivotal engagement with the first leg 30. The second leg 32 has an outer face 58 and an inner face 60, an aperture 62 positioned near the distal end 54 and extending through the second leg 32 from the outer face 58 to the inner face 60, and a plurality of apertures 64, 66, 68, 70, and 72 positioned on the proximal end 56 extending through the second leg 32 from the outer face 58 to the inner face 60. The second leg 32 further including a first slot 74 positioned in the distal end 54 to receive a portion of the lower connector bar 16 therein and a second slot 76 positioned near the proximal end 56 to receive a portion of the upper connector bar 18 therein.

Figure 2:
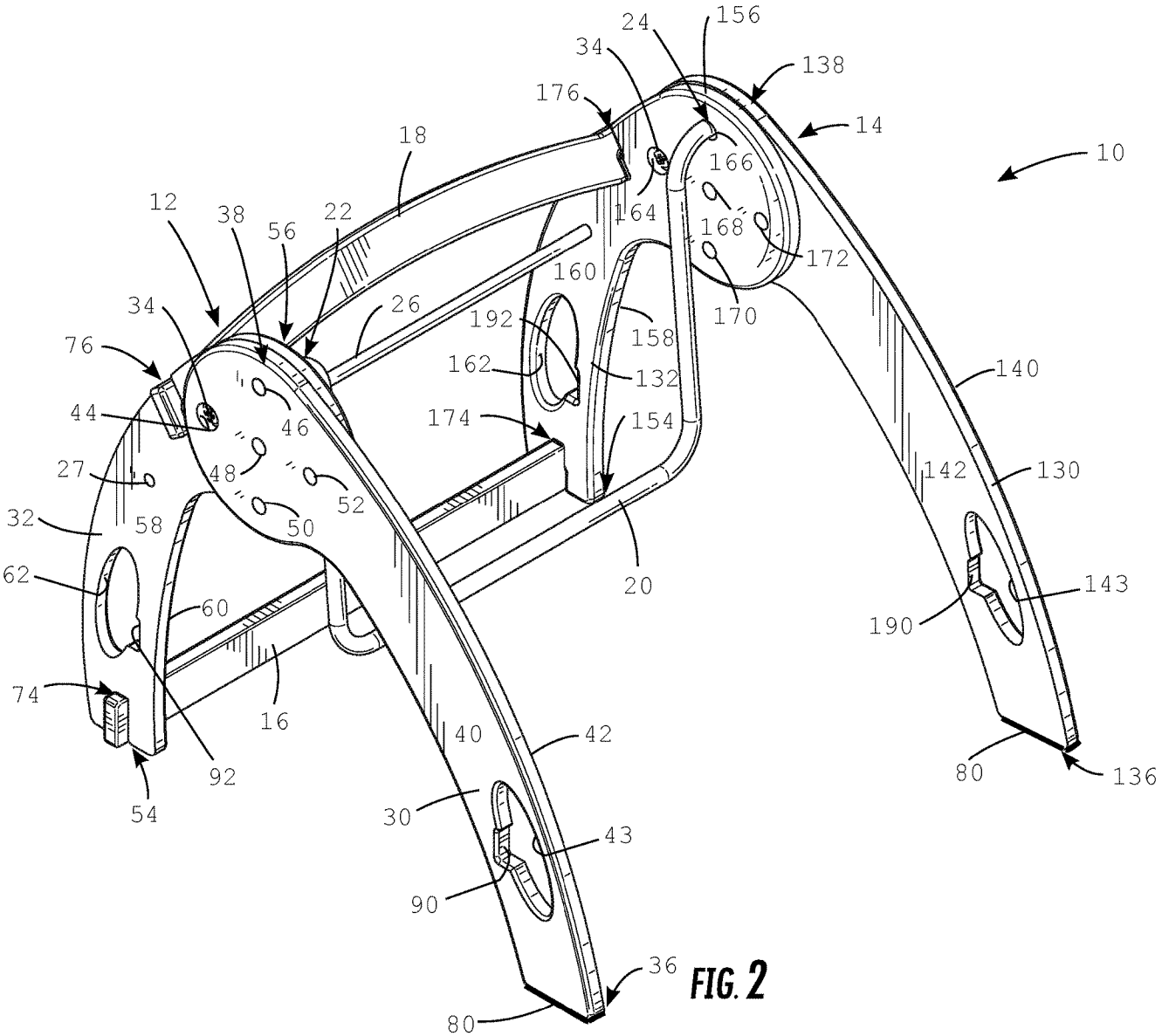
FIG. 2 is a perspective view of the portable foot swing of FIG. 1.
Figure 3:
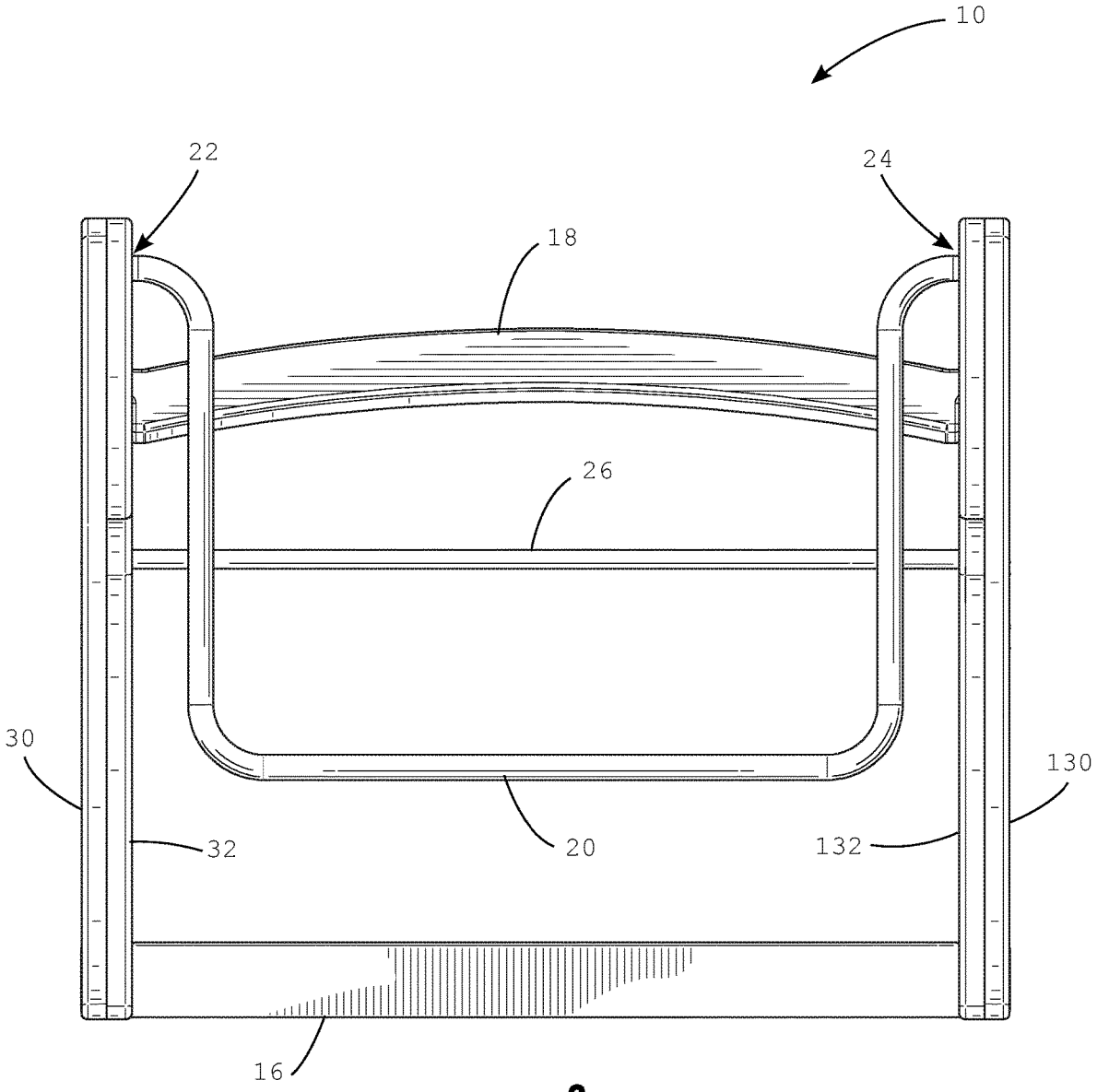
FIG. 3 is a front elevation of the portable foot swing of FIG. 1.
Figure 4:
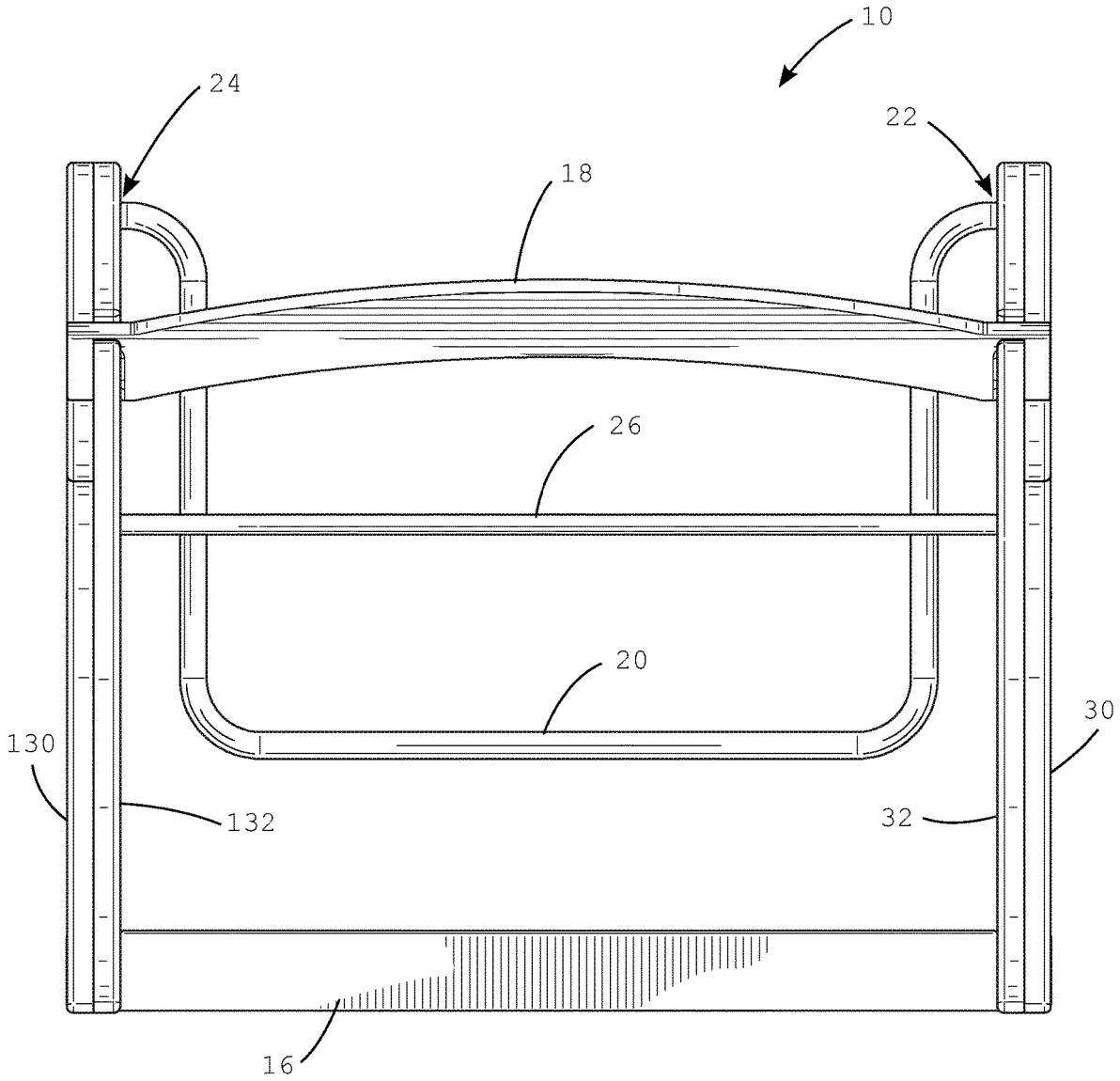
FIG. 4 is a rear elevation of the portable foot swing of FIG. 1.

The first and second legs 30 and 32 are pivotally connected by connector 34 at the proximal ends 38 and 56 such that the inner face 42 of the first leg 30 resides against the outer face 58 of the second leg 32 so that the first leg 30 is offset from the second leg 32 to allow a "scissor" type action when the legs 30 and 32 are moved from an open position, shown in FIG. 2, to a collapsed position where the distal ends 36 and 54 reside adjacent to each other.

Apertures 44, 46, 48, 50, and 52 of the first leg 30 have a pattern to match apertures 64, 66, 68, 70, and 72 of the second leg 32 when in the open position. As shown, connector 34 extends through apertures 44 and 64 to pivotally connect the first leg 30 to the second leg 32.

Like the first support 12, the second support 14 includes a first leg 130 pivotally connected to a second leg 132 by a fastener and/or connector 34. The first leg 130 has a distal end 136 adapted to rest on a support surface and a proximal end 138 configured for pivotal engagement with the second leg 132.

The first leg 130 includes an outer face 140 and an inner face 142, an aperture 143 positioned near the distal end 136 extending through the first leg 130 from the outer face 140 to the inner face 142, and a plurality of apertures 144, 146, 148, 150, and 152 positioned on the proximal end 138 extending through the first leg 130 from the outer face 140 to the inner face 142.

The second leg 132 also includes a distal end 154 adapted to rest on a support surface and a proximal end 156 configured for pivotal engagement with the first leg 130. It should be appreciated that one or more of the distal ends 36, 136, 54, and 154 includes a traction material, such as rubber 80 positioned thereon to prevent the foot swing 10 from sliding along the support surface when in use. It should be appreciated that the traction material may also be positioned along a bottom of lower connector bar 16 to prevent sliding. The second leg 130 has an outer face 158 and an inner face 160, an aperture 162 positioned near the distal end 154 extending through the second leg 132 from the outer face 158 to the inner face 160, and a plurality of apertures 164, 166, 168, 170, and 172 positioned on the proximal end 156 extending through the second leg 132 from the outer face 158 to the inner face 160. The second leg 132 further including a first slot 174 positioned in the distal end 154 to receive a portion of the lower connector bar 16 therein and a second slot 176 positioned near the proximal end 156 to receive a portion of the upper connector bar 18 therein.

The first and second legs 130 and 132 are pivotally connected by connector 34 at the proximal ends 138 and 156 such that the inner face 142 of the first leg 130 resides against the outer face 158 of the second leg 132 so that the first leg 130 is offset from the second leg 132 to allow a "scissor" type action when the legs 130 and 132 are moved from an open position, shown in FIG. 2, to a collapsed position where the distal ends 136 and 154 reside adjacent to each other. As shown, the first legs 30, 130 are longer than second legs 32 and 132; however, it should be appreciated that the first legs 30, 130 and second legs 32, 132 may be of the same length depending on the size and configuration desired.

Apertures 144, 146, 148, 150, and 152 of the first leg 130 have a pattern to match apertures 164, 166, 168, 170, and 172 of the second leg 132 when in the open position. As shown, connector 34 extends through apertures 144 and 164 to pivotally connect the first leg 130 to the second leg 132.

Figure 5:
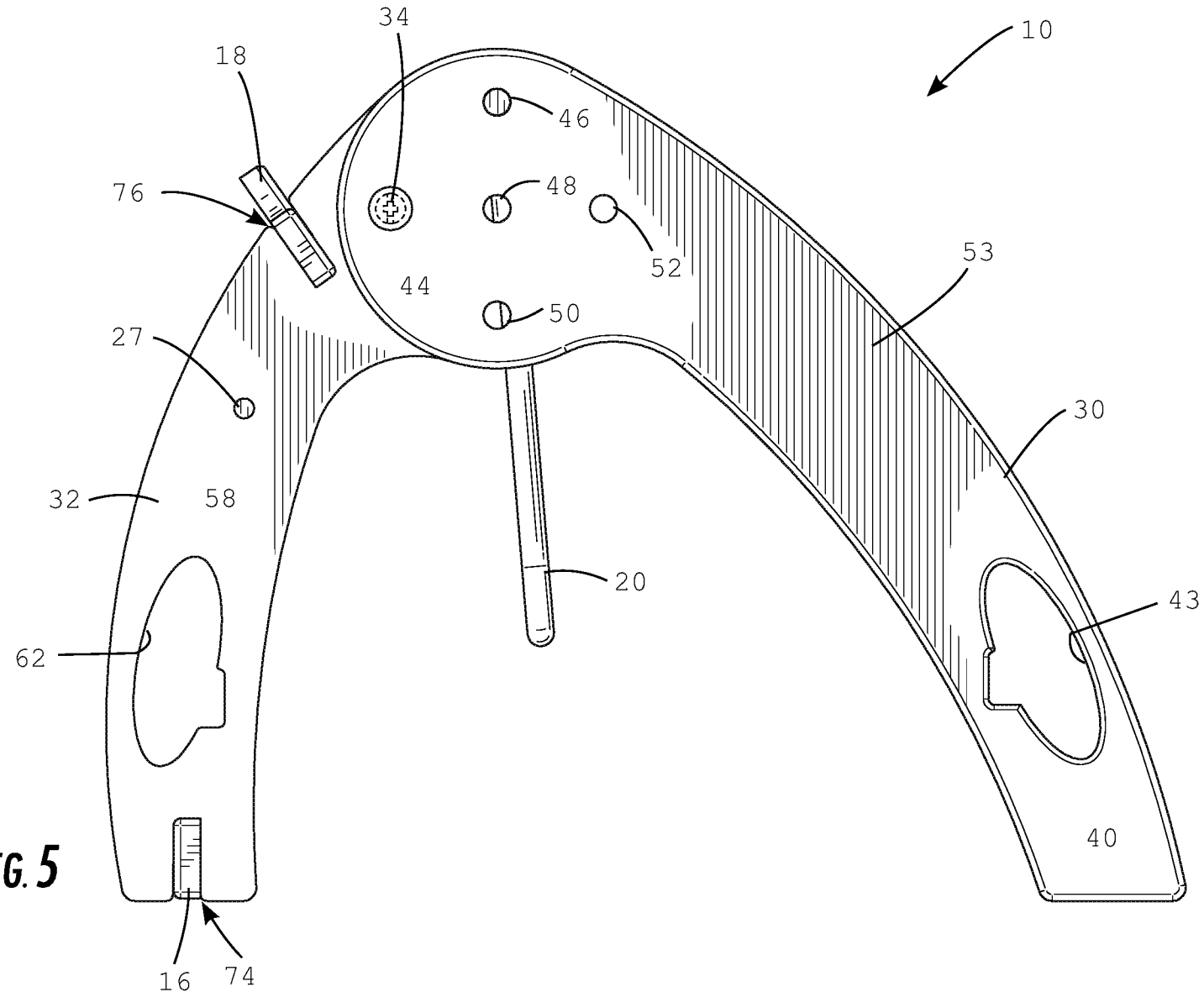
FIG. 5 is a left side view of the portable foot swing of FIG. 1.
Figure 5A:
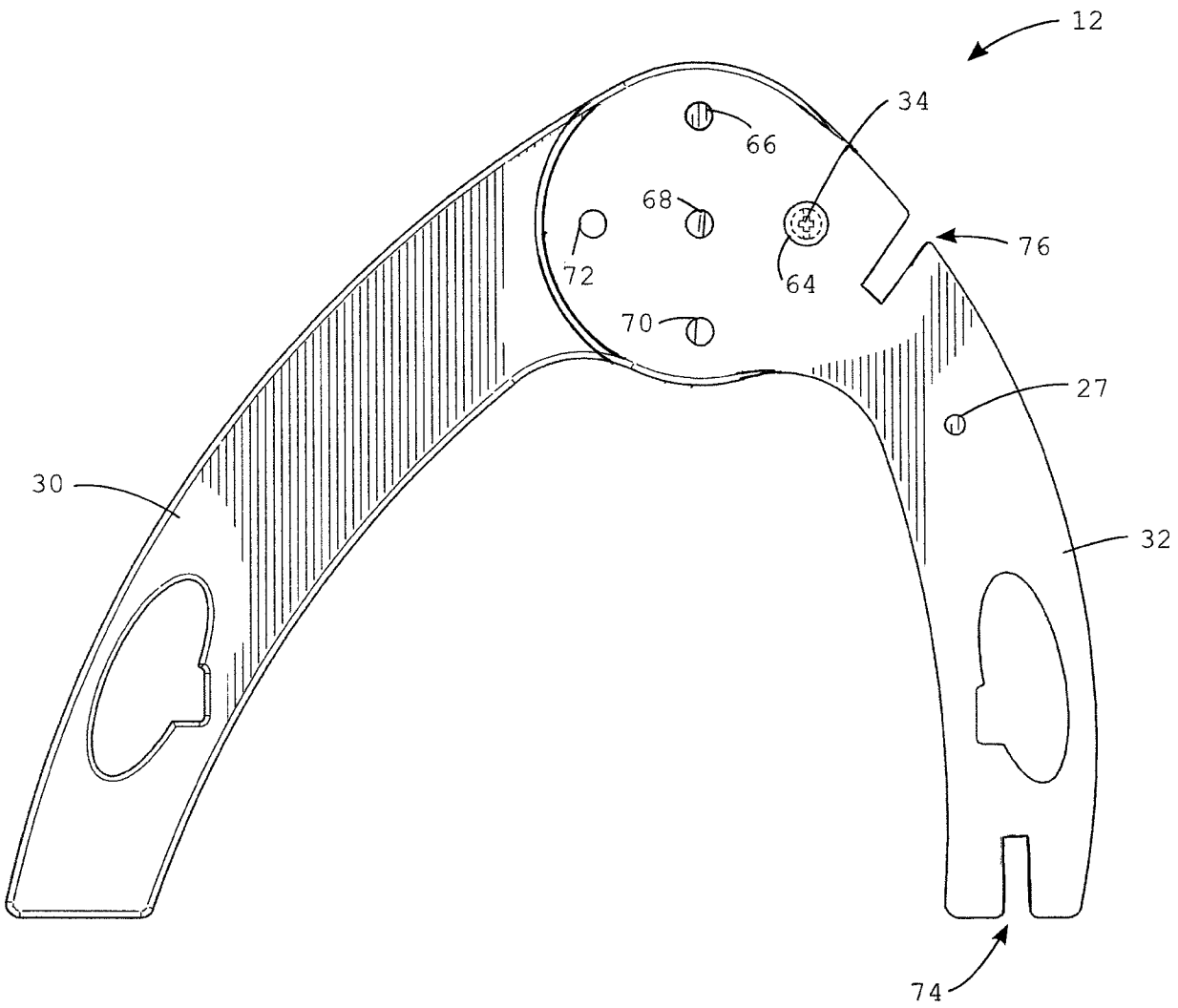
FIG. 5A is an inside view of a first support of the portable foot swing of FIG. 1.
Figure 6:
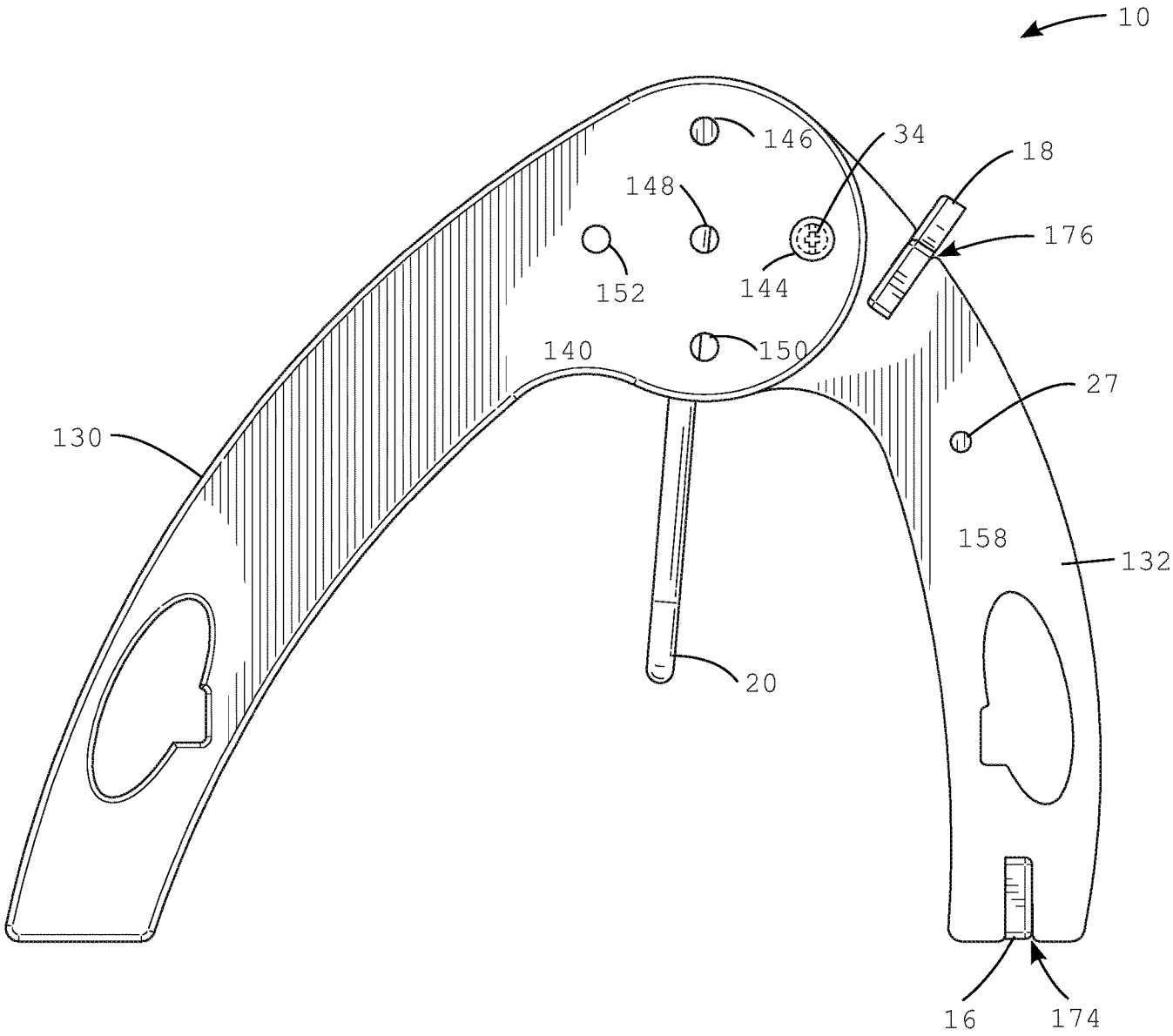
FIG. 6 is a right side view of the portable foot swing of FIG. 1.
Figure 7:
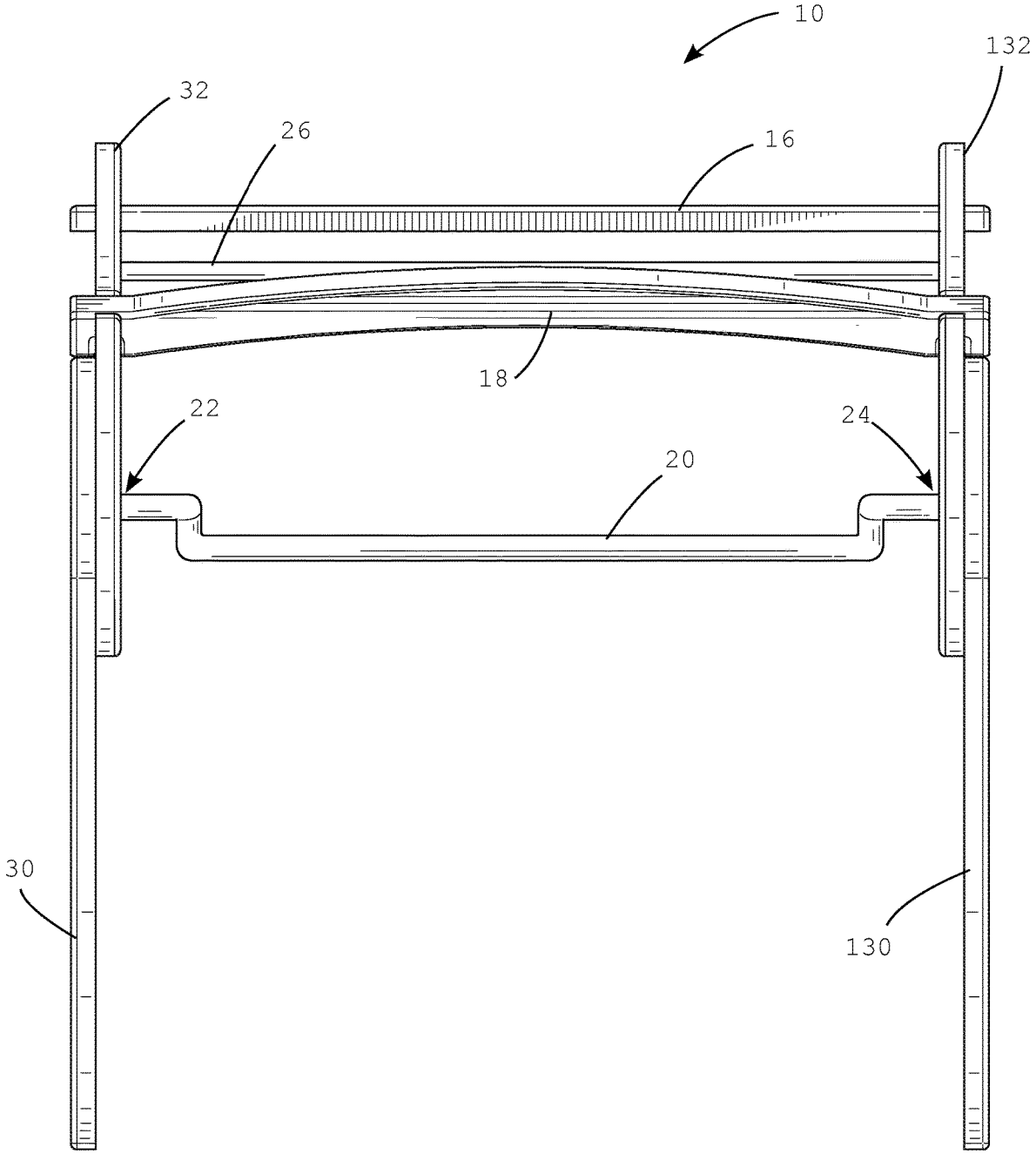
FIG. 7 is a top view of the portable foot swing of FIG. 1.
Figure 8:
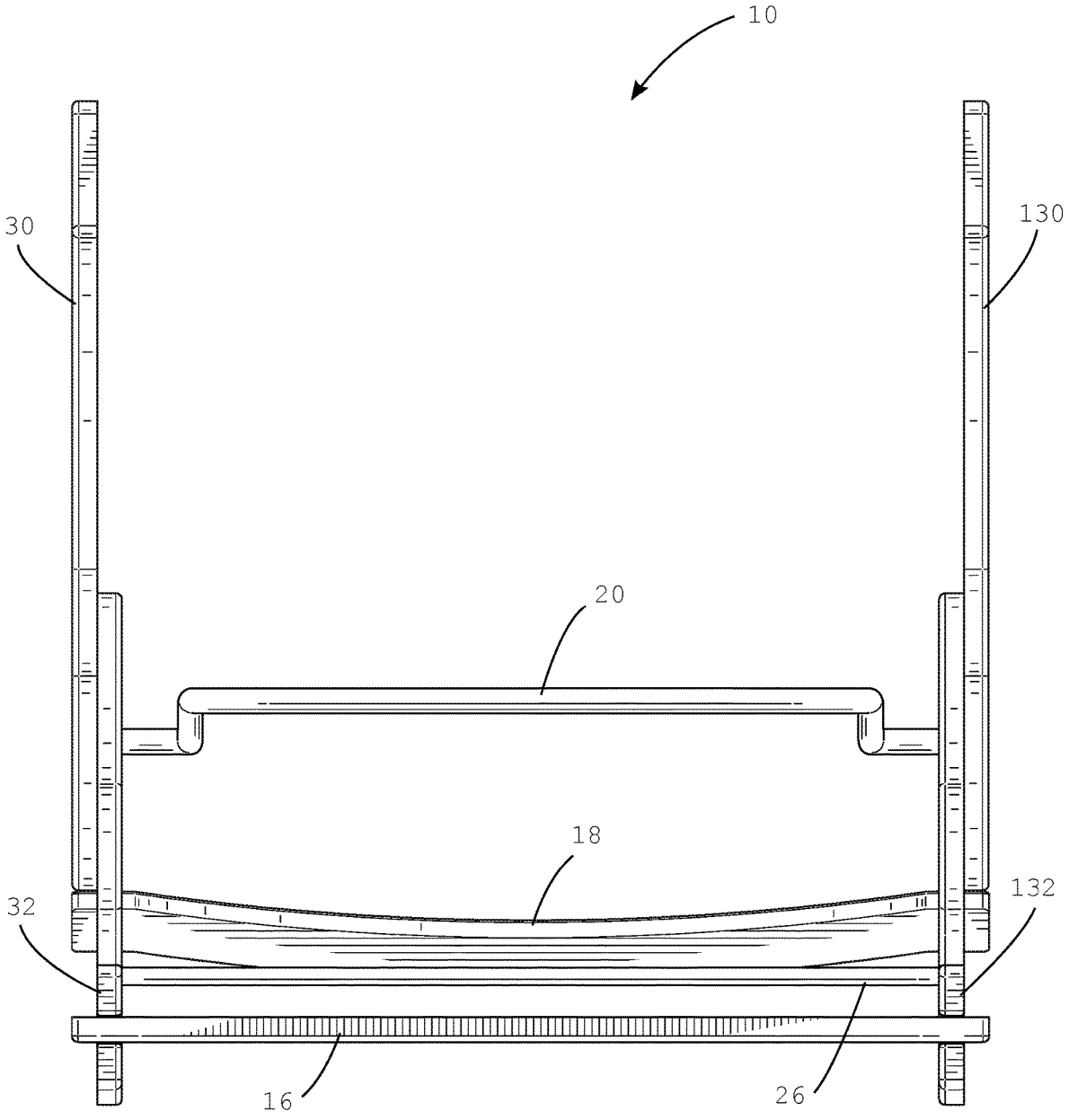
FIG. 8 is a bottom view of the portable foot swing of FIG. 1.

Apertures 53 may also be formed in one or more of the first and second legs 30, 32, 130, and 132 to provide a writing utensil holder for pencils, pens, and any other suitable writing utensil, FIG. 5.

As illustrated, foot support 20 is pivotally connected to the first and second supports 12 and 14 by inserting distal end 22 into a respective one of the apertures 66, 68, 70, and 72 and inserting distal end 24 into a respective one of the apertures 166, 168, 170, and 172. The position of the foot support 20 can be changed by moving the distal ends into another aperture. For example, it can be lowered by removing the distal ends 22 and 24 from apertures 66 and 164 and inserting the distal end 22 into aperture 68 and distal end 24 into aperture 168, or moved forward towards a user by inserting distal end 22 into aperture 72 and distal end 24 into aperture 172.

Like foot support 20, elastic member 26 extends between the first support 12 and the second support 14. As shown, the elastic member 26 extends between the second leg 32 of the first support 12 and the second leg 132 of the second support 14. As shown, the elastic member 26 is positioned along the second legs 32 and 132 closer to the second distal ends 56 and 156 than the first distal ends 36 and 136; however, it should be appreciated that the elastic member 26 may be positioned anywhere along a length of the second legs 32 and 132.

Figure 9:
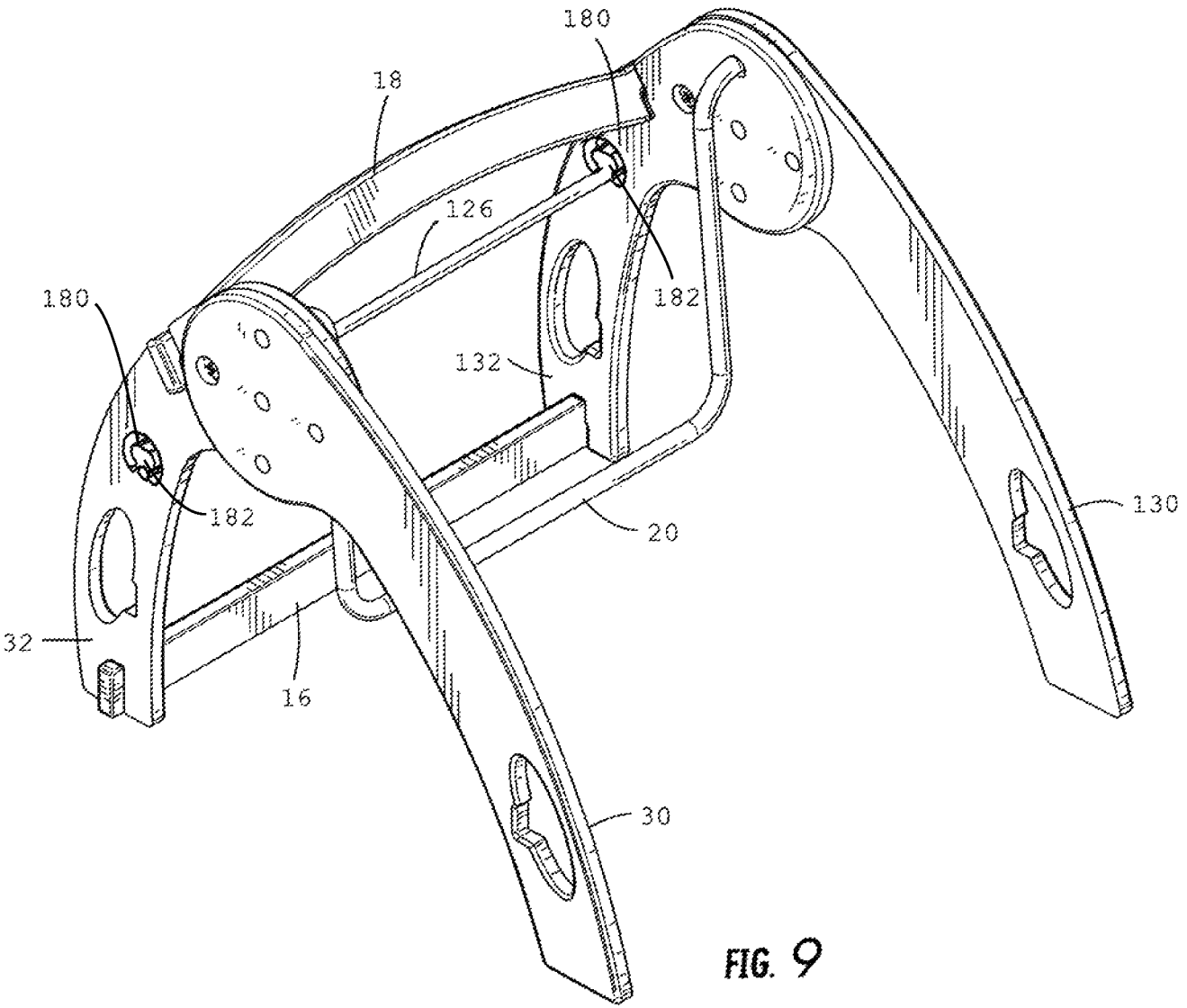
FIG. 9 is a perspective view of a portable foot swing.
Figure 10:
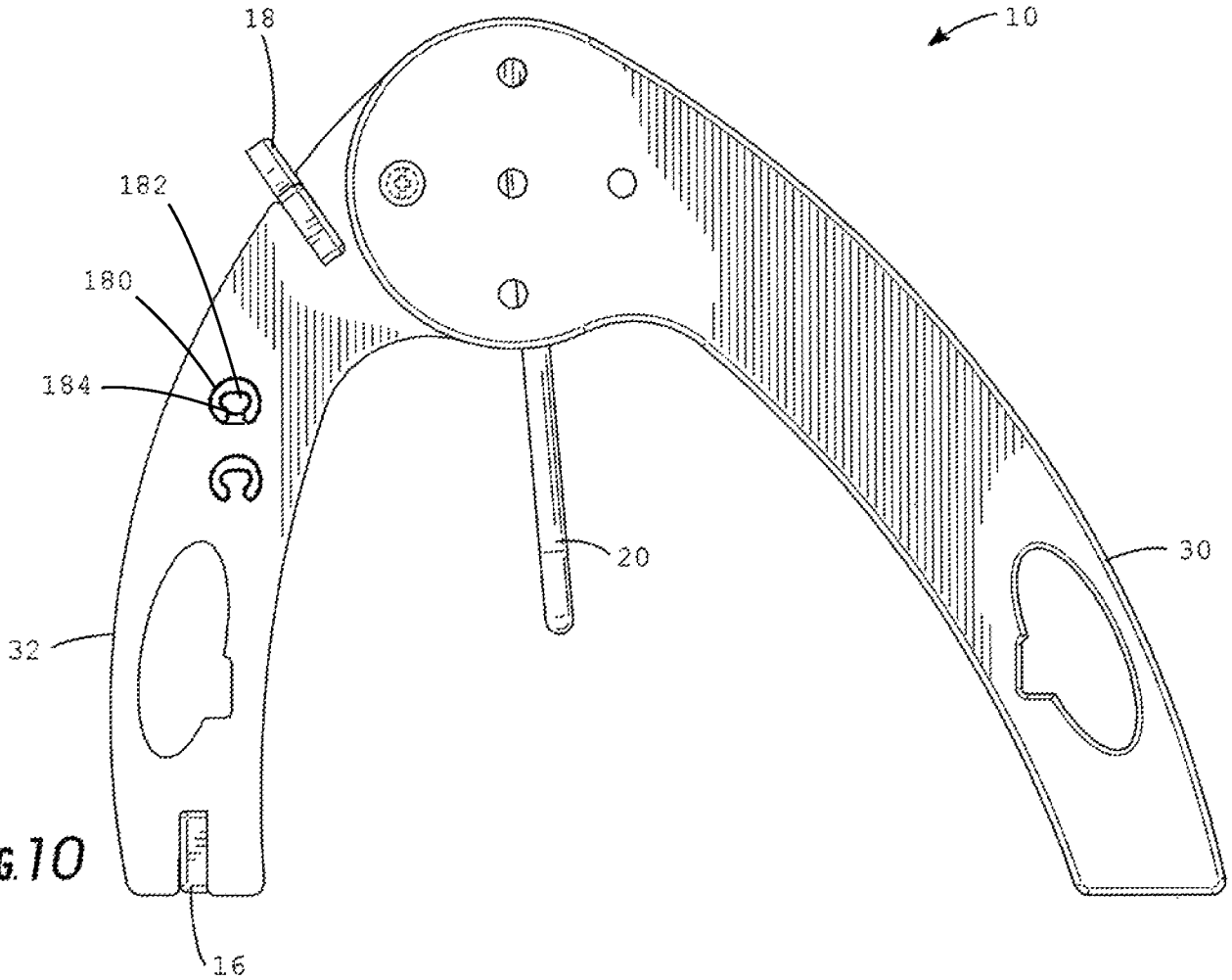
FIG. 10 is a left side view of the portable foot swing of FIG. 9.

The elastic member 26 may be connected to the second legs 32 and 132 by adhesive, fasteners, and any other suitable method. As illustrated, the elastic member 26 is secured by fasteners 27. Alternatively, as shown in FIGS. 9 and 10, a slot 180 may be formed in the second legs 32 and 132. As shown, the slot 180 has a "horseshoe" shape that creates a projection 182. It should be appreciated that the slot 180 may be of any shape which forms the projection 182. The slot 180 and projection 182 allow an elastic member 126 with loops 184 formed on opposing ends to be slid over the projections 182, thereby securing the elastic member 126 between the first and second supports 12 and 14. As discussed with respect to the foot support 20, the elastic member 26 may also be adjustable. As shown in FIG. 10, multiple connection points, i.e. slots 180 and projections 182, may be included along second legs 32 and 132 to allow the elastic member 26 to be lowered and raised as desired.

The portable foot swing 10 is designed to be portable by allowing the foot swing 10 to be collapsed into a smaller package. In use, a user would move the first and second supports 12 and 14 from the collapsed position to the open position, see FIG. 2, where apertures 46, 48, 50, and 52 are aligned with apertures 66, 68, 70, and 72 on the first support 12 and apertures 146, 148, 150, and 152 are aligned with apertures 166, 168, 170, and 172 of the second support 14. The user then inserts distal end 22 of the foot support 20 into one of apertures 66, 68, 70, and 72 and inserts distal end 24 into a corresponding one of the apertures 166, 168, 170, and 172. The distal ends 22 and 24 are sized to provide a friction fit with apertures 66, 68, 70, and 72 and 166, 168, 170, and 172. This prevents the foot support 20 from freely swinging and when not in use, allows the user to push the foot support 20 up and out of the way.

With the foot support 20 installed between the first and second supports 12, 14, the user then positions lower connector bar 16 into slots 74 and 174 respectively to interconnect distal ends 54 and 154 of the second legs 32 and 132. Once the lower connector bar 16 is installed, the upper connector bar 18 is installed in slots 76 and 176. It should be appreciated that the upper connector bar 18 may be installed prior to the lower connector bar 16. It should also be appreciated that the upper connector bar 18 may be secured in position by friction fit and/or by a fastener such as a set screw. The elastic member 26 may also be installed between second legs 32 and 132. The elastic member 26 allows a user to bounce his/her foot up and down on the elastic member 26—such bouncing helps children with SPD relieve the pressures of the day by providing a sensory input when the child pushes against the elastic member 26. The elastic member 26 may also be used to secure the foot support 20 up and out of the way.

Once the foot swing 10 has been assembled, the user may place the foot swing 10 under a workstation or desk to allow the user to move the foot support 20 in a pivotal motion, see FIG. 1, with his/her foot, simply rest his/her foot thereon, or place his/her foot on the elastic member 26 to provide a bouncing motion. Apertures 43, 62, 143, and 162 allow the user to secure the foot swing 10 to legs of a desk using hook and loop fastener strips, rope, and/or any other suitable connector. Apertures 43, 62, 143, and 162 include a cutout 90, 92, 190, 192 for securing the hook and loop fastener strips, rope, etc. in position within the apertures 43, 62, 143, and 162. In other words, the cutouts 90, 92, 190, 192 prevent the hook and loop fastener strips, rope, etc. from sliding and/or moving within the apertures 43, 62, 143, and 162, thereby providing a secure and/or solid anchor point when securing the foot swing 10 to a desk and/or other structure.

When the user is finished using the foot swing 10, the user can collapse the foot swing 10 into a smaller package for storage or transport. In collapsing the foot swing 10, the user disconnects the elastic member 26, removes lower and upper connector bars 16 and 18, removes foot support 20, and collapses the first and second supports 12 and 14. With everything broken down, the user can then pack the pieces into a bag, backpack, or other suitable carry device and take the foot swing 10 with them for use in another room, etc.

The foot swing 10 allows children to move without distracting the classroom via a swinging motion using the foot support 20 or a bouncing motion using the elastic member 26. Such movement provides the benefits of calming and/or stimulating a child's brain, refocusing the children, improving in-seat behavior so that teachers do not have to redirect the children, and provide sensory input to help children relieve pressure due to sensory overload during the day.

The foregoing has described a portable foot swing. All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends any novel one, or any novel combination, of the features disclosed in this specification (including any accompanying claims, abstract and drawings), or to any novel one, or any novel combination, of the steps of any method or process so disclosed.

What is claimed is:

1. A foot swing, comprising:

a first support having a first leg pivotally connected to a second leg;

a second support spaced from the first support, the second support having a first leg pivotally connected to a second leg; and a foot support extending between the first and second supports, the foot support including a first cylindrical distal end pivotally connected to the first support and a second cylindrical distal end pivotally connected to the second support to permit the foot support to swing relative to the first and second supports;

an elastic member extending between the second leg of the first support and the second leg of the second support, a first distal end of the elastic member being connected to the second leg of the first support and a second distal end of the elastic member being connected to the second leg of the second support, wherein the second leg of the first support includes a plurality of slots configured to secure the first distal end of the elastic member thereto and the second leg of the second support includes a plurality of slots configured to secure the second distal end of the elastic member thereto, and wherein a position of the elastic member is changed by moving the first and second distal ends of the elastic member to a different one of the plurality of slots.

2. The foot swing according to claim 1, further including a first connector extending between the first and second supports, the first connector securing the first and second supports together in a spaced-apart relation.

3. The foot swing according to claim 1, further including a second connector extending between the first and second supports, the second connector securing the first and second supports together in a spaced-apart relation.

4. The foot swing according to claim 1, wherein each of the first and second legs of the first support include a distal end configured to rest on a surface and a proximal end spaced from the surface, and wherein, the proximal end of the first leg is pivotally connected to the proximal end of the second leg such that the first and second legs move relative to each other in a scissor movement.

5. The foot swing according to claim 1, wherein each of the first and second legs of the second support include a distal end configured to rest on a surface and a proximal end spaced from the surface, and wherein, the proximal end of the first leg is pivotally connected to the proximal end of the second leg such that the first and second legs move relative to each other in a scissor movement.

6. The foot swing according to claim 4, wherein the proximal end of the first leg and the proximal end of the second leg each include apertures for receiving the first cylindrical distal end of the foot support, wherein when the first and second legs are in a use position, the apertures in the first leg and the apertures in the second leg align to allow the first cylindrical distal end to be inserted therein.

7. The foot swing according to claim 6, wherein the proximal end of the first leg and the proximal end of the second leg each include a plurality of apertures that align in the use position to permit an elevation of the foot support to be changed.

8. The foot swing according to claim 5, wherein the proximal end of the first leg and the proximal end of the second leg each include apertures for receiving the second cylindrical distal end of the foot support, wherein when the first and second legs are in a use position, the apertures in the first leg and the apertures in the second leg align to allow the second cylindrical distal end to be inserted therein.

9. The foot swing according to claim 8, wherein the proximal end of the first leg and the proximal end of the second leg each include a plurality of apertures that align in the use position to permit an elevation of the foot support to be changed.

10. The foot swing according to claim 2, wherein the first connector extends between and interconnects a distal end of the second leg of the first support and a distal end of the second leg of the second support.

11. The foot swing according to claim 3, wherein the second connector extends between and interconnects a proximal end of the second leg of the first support and a proximal end of the second leg of the second support.

12. The foot swing according to claim 1, wherein a distal end of the first leg of the first support and a distal end of the first leg of the second support each include a non-slip material disposed thereon to prevent movement of the foot swing during use.

13. The foot swing according to claim 1, wherein the first and second supports include apertures for receiving the first and second cylindrical distal ends of the foot support therein to pivotally connect the foot support to the first and second supports, wherein the first and second cylindrical distal ends are secured in the apertures by a friction fit, thereby preventing the foot support from moving freely.

14. A foot swing, comprising:

a first support spaced-apart from a second support, each of the first and second supports having a first leg pivotally connected to a second leg;

a foot support extending between the first and second supports, the foot support including a first cylindrical distal end pivotally connected to the first support and a second cylindrical distal end pivotally connected to the second support to permit the foot support to swing relative to the first and second supports; and an elastic member spaced from the foot support and extending between the second leg of the first support and the second leg of the second support, a first distal end of the elastic member being connected to the second leg of the first support and a second distal end of the elastic member being connected to the second leg of the second support, wherein the second leg of the first support includes a plurality of slots configured to secure the first distal end of the elastic member thereto and the second leg of the second support includes a plurality of slots configured to secure the second distal end of the elastic member thereto, and wherein a position of the elastic member is changed by moving the first and second distal ends of the elastic member to a different one of the plurality of slots.

15. The foot swing according to claim 14, wherein the elastic member is spaced from the foot support to enable the elastic member to hold the foot support in an up position.

* * * * *